US006320160B1

(12) United States Patent
Eidsnes et al.

(10) Patent No.: US 6,320,160 B1
(45) Date of Patent: Nov. 20, 2001

(54) METHOD OF FLUID TRANSPORT

(75) Inventors: Trond Eidsnes, Fjøsanger; Olav Ellingsen, Florø, both of (NO)

(73) Assignee: Consensus AB, Fana (NO)

( * ) Notice: Subject to any disclaimer, the term of this patent is extended or adjusted under 35 U.S.C. 154(b) by 0 days.

(21) Appl. No.: 09/446,519

(22) PCT Filed: Jun. 29, 1998

(86) PCT No.: PCT/NO98/00198

§ 371 Date: Feb. 1, 2000

§ 102(e) Date: Feb. 1, 2000

(87) PCT Pub. No.: WO99/00166

PCT Pub. Date: Jan. 7, 1999

(30) Foreign Application Priority Data

Jun. 30, 1997 (NO) ..... 19973041

(51) Int. Cl.[7] ..... H05B 1/00

(52) U.S. Cl. ..... 219/211; 219/212; 219/529; 219/549; 219/545

(58) Field of Search ..... 219/211, 212, 219/209, 210, 217, 528, 529, 545, 549; 36/43, 44; 361/224; 442/179; 252/62.9 R; 428/408

(56) References Cited

U.S. PATENT DOCUMENTS

| | | | | |
|---|---|---|---|---|
| 3,493,986 | | 2/1970 | Erwin | 12/142 R |
| 4,031,352 | * | 6/1977 | Oosterberg | 219/212 |
| 4,205,223 | * | 5/1980 | Cole | 219/212 |
| 4,251,717 | * | 2/1981 | Cole | 219/212 |
| 4,277,670 | * | 7/1981 | Mori et al. | 219/212 |
| 4,359,626 | * | 11/1982 | Potter | 219/212 |
| 4,549,074 | * | 10/1985 | Matsuo | 219/212 |
| 4,658,119 | * | 4/1987 | Endo et al. | 219/212 |
| 4,780,968 | * | 11/1988 | Bragagnolo | 219/211 |
| 4,885,456 | * | 12/1989 | Tanaka et al. | 219/212 |
| 5,105,067 | * | 4/1992 | Brekkestran et al. | 219/211 |
| 5,233,769 | | 8/1993 | Weber | 36/44 |
| 5,281,470 | | 1/1994 | Kobayashi et al. | 442/179 |
| 6,078,025 | * | 6/2000 | Yeung | 219/211 |

* cited by examiner

*Primary Examiner*—Teresa Walberg
*Assistant Examiner*—Fadi H. Dahbour
(74) *Attorney, Agent, or Firm*—Young & Thompson

(57) ABSTRACT

A method for the transport of liquid in a textile or porous structure, whereby the liquid is forced to travel through the textile with the aid of electric pulses applied to a conductor or semi-conductor which is woven onto, or in some other fashion applied to, each side of the material which may be a single textile or several layers of textiles which together form a laminate.

9 Claims, 5 Drawing Sheets

METHOD OF FLUID TRANSPORT

CROSS REFERENCE TO RELATED APPLICATION

This is the 35 USC 371 national stage of International application PCT/NO98/00198 filed on Jun. 29, 1998, which designated the United States of America.

FIELD OF THE INVENTION

The present invention relates to a method for the transport of liquid, e.g., perspiration through one or more layers of textiles.

BACKGROUND OF THE INVENTION

In connection with all kinds of garments, and in particular garments used for sports or physical labour, the body exudes perspiration which ideally ought to be transported away from the skin in order to keep it as dry as possible. Since the majority of types of textiles, and especially synthetic textiles, do not have the property that they efficiently transport moisture from the skin, a person, after perspiring, will quite soon begin to feel cold because of the moisture residing in the fabric. This is connected with the fact that the moisture which is removed through evaporation draws much of the heat for the evaporation from the body. One of the few fabrics which seems to have a considerable measure of water transport capacity are woollen fabrics. This is related to the fact that there are capillaries in the wool fibres which have a high liquid transport capacity. When the liquid is drawn away from the skin, evaporation will take place with the aid of heat from the surroundings.

Modern pieces of clothing, and in particular pieces of clothing which are expected to be exposed to perspiration (tracksuits, parka jackets etc.) are often composed of several layers (laminates) of textiles, by means of which an attempt is made to secure insulation together with optimal liquid transport capacity. A known way of optimising this when dressing in cold conditions where perspiration is expected to occur is to have woollen underwear next to the body, which serves to transport the moisture into the outer clothes.

A number of different methods are known which seek to solve this problem in a best possible way. One of these is by using a combination of different types of fibres which have capillary liquid transport properties. German patent publication DE 38 31 970 describes a solution using an electrifiable membrane able to transport liquid according to the principles used in dialysis apparatus.

However, there are no satisfactory solutions which have been put into technical or commercial use, and so the "sweat problem" described above is still perceived as a problem in connection with the aforementioned clothes.

SUMMARY OF THE INVENTION

The object of the present invention is to provide a solution to this problem which cannot only be used on clothes, but which can also be applied to, for example, shoes, tents etc., where there is a need for the transport of liquid through one or more layers of textiles.

The principle of the present invention is that on each side of a textile, or as a part thereof, there are woven therein or printed thereon conductors or semiconductors to which a pulsating direct current is applied which sets the water molecules in motion. The current pulses may be supplied to the conductors or semi-conductors by means of a battery where the current pulses are generated in a small oscillatory circuit built up of a capacitor which is discharged through a short circuit after charging. The current pulses may otherwise be generated by an oscillating generator consisting of a permanent magnet and a coil. The permanent magnet which may be suspended in a spring arrangement, is set in motion by the body's own movements, so that each time the magnetic field cuts through the coil windings, an electric voltage is induced in the coil which gives the desired electrical pulse in the semi-conductors.

BRIEF DESCRIPTION OF THE DRAWINGS

The invention will be explained in more detail below with the aid of the appended drawings, wherein.

DETAILED DESCRIPTION OF THE INVENTION

Figure 1:
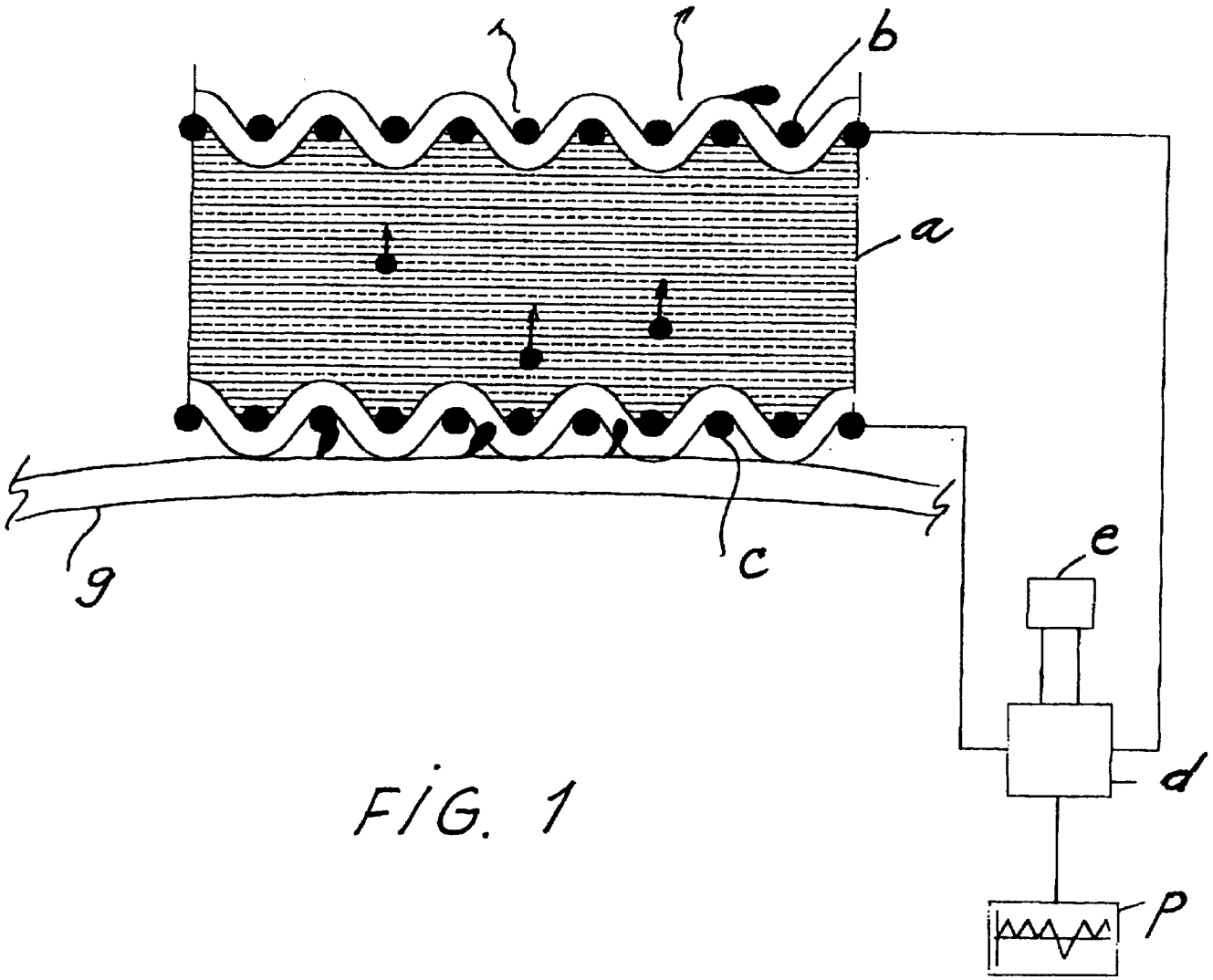
FIG. 1 is a schematic outline of the principle of the present invention.

In FIG. 1 a) indicates a section of a piece of cloth which may consist of one or more layers. On each side thereof there is either woven therein or applied thereto a web of semi-conductor material b) and c). The materials b) and c) may be the same material or different materials. The semi-conductor materials are connected to the electric pulse transmitter d) which in the illustrated case receives power from a battery e). The pulse transmitter d) is constructed in a conventional manner to transmit a series of unidirectional pulses interrupted by a pulse of opposite polarity as illustrated in the window f). When the body exudes perspiration through the skin g), the liquid, in a purely mechanical fashion and with the aid of the capillaries in the fabric, will penetrate therein so that the garment becomes moist. When the pulsating voltage is turned on, the water will be driven from the skin side in a direction away from the body. The water migration will result in an accumulation of water towards the outside of the garment which will be removed in part through evaporation and in part in that drops are formed which run away.

Figure 2:
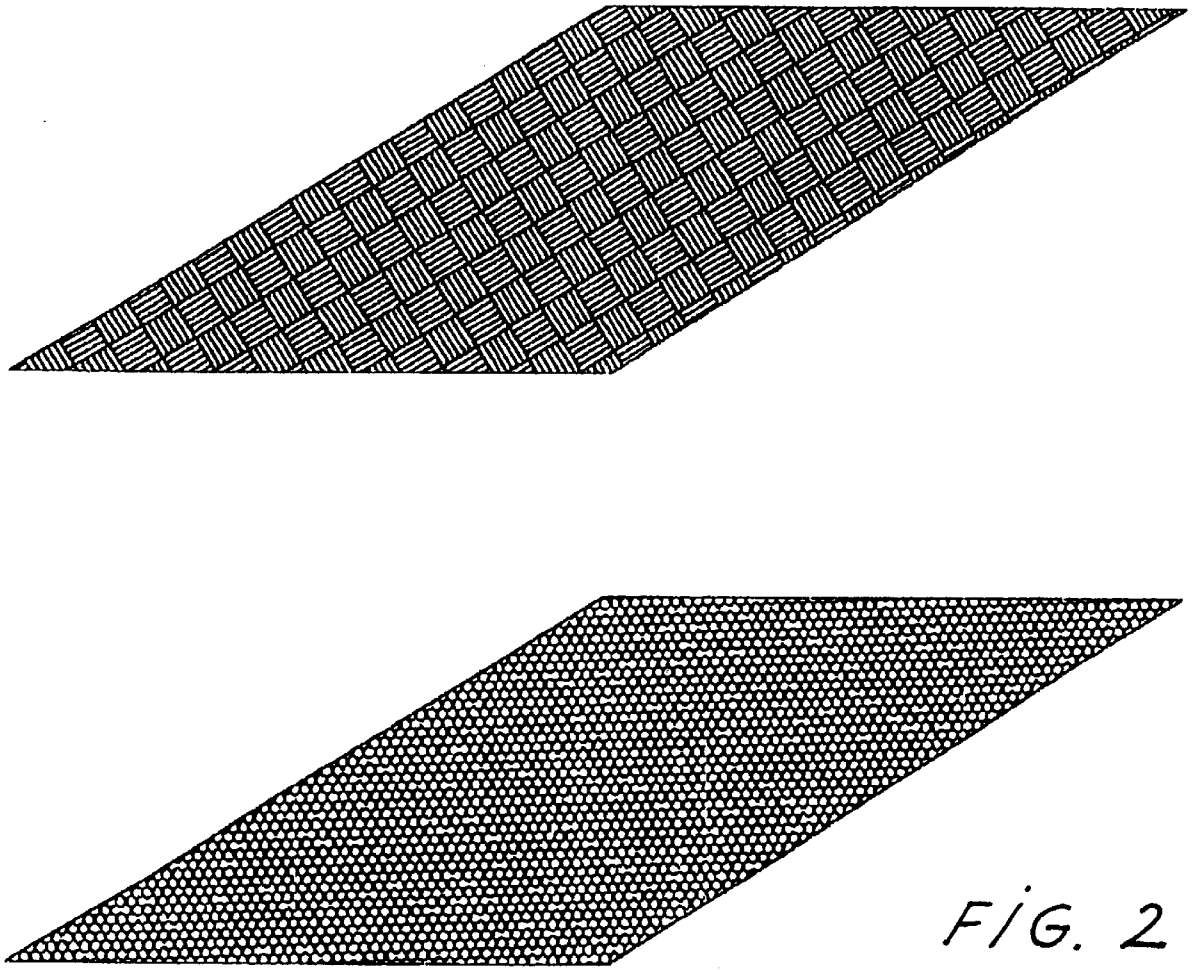
FIG. 2 shows examples of woven or perforated films for attachment to garments to effect liquid transport.
Figure 3:
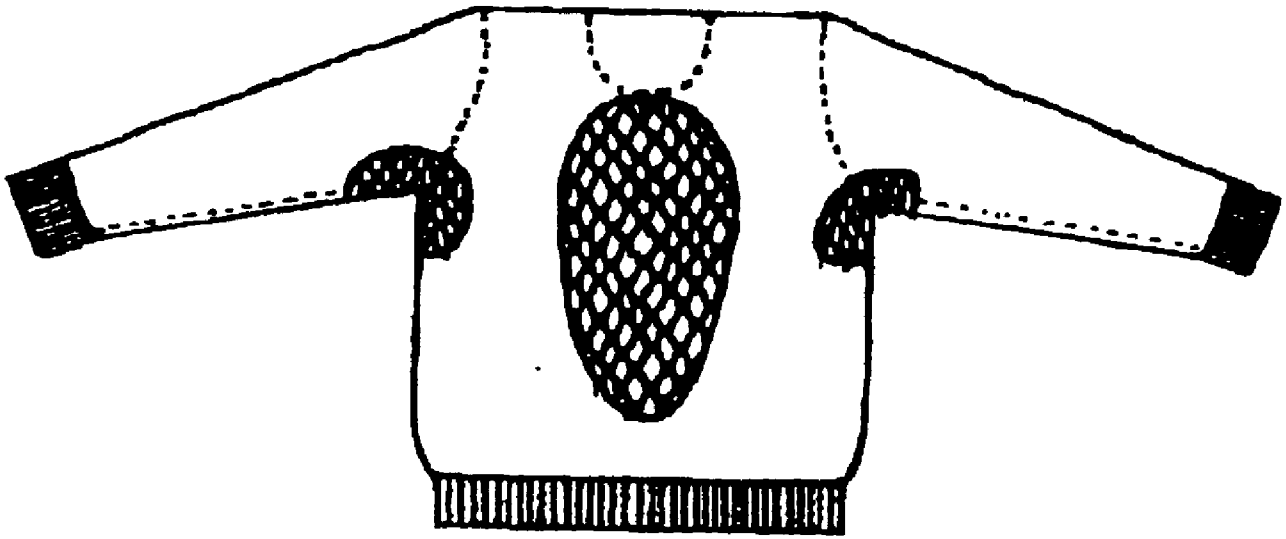
FIG. 3 shows a garment having woven or perforated films according to FIG. 2 attached thereto.

The actual semi-conductor material may consist of all types of known conductors or semi-conductors, which can be produced either as threads capable of being woven together exclusively and/or together with other textiles and/or can be produced as perforated films capable of being attached, for example, glued or sewn, to a garment in the areas it is desirable to "drain". This is illustrated in FIG. 2. Typically, such areas are under the arms and on the back of a jacket, as shown in FIG. 3.

Figure 4:
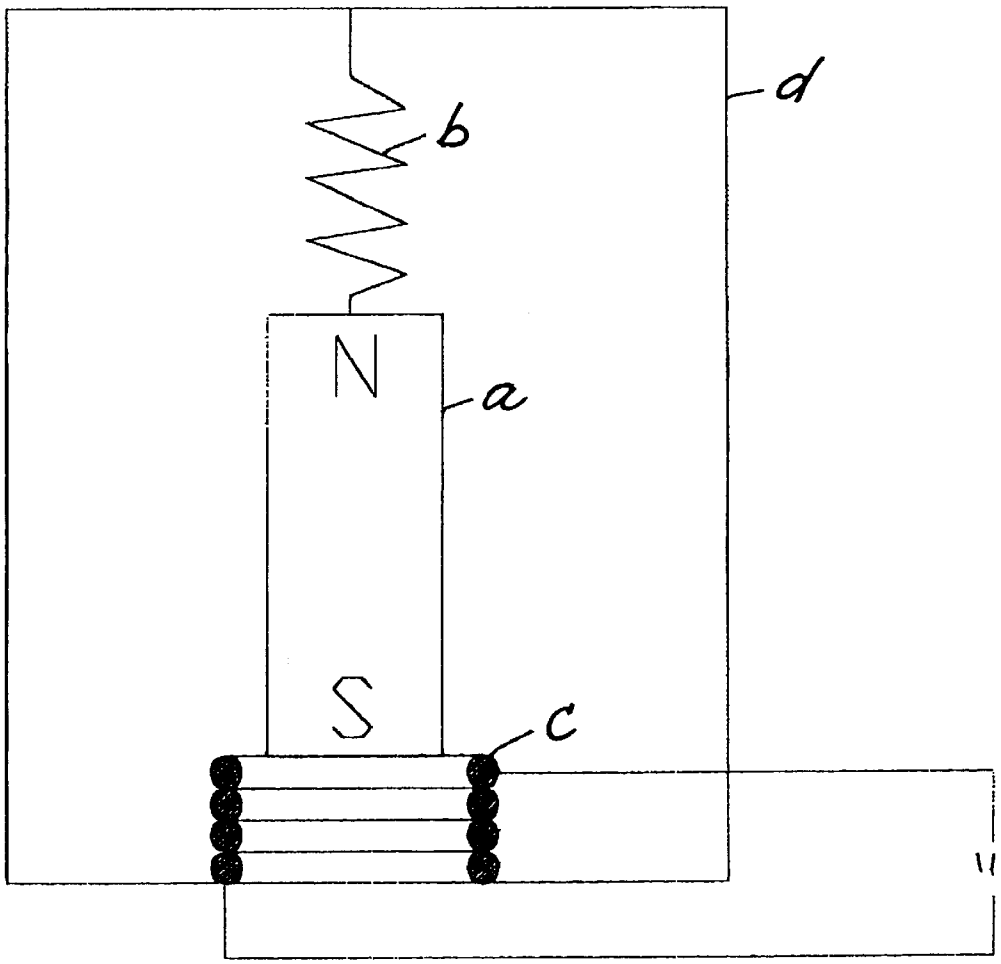
FIG. 4 illustrates the principle of the oscillating generator.

FIG. 4 shows the principle of the oscillating generator. This consists of a permanent magnet a) which is suspended in a spring b), so that one end of the magnet can travel into a coil c). The entire unit is built inside a housing d).

Figure 5C:
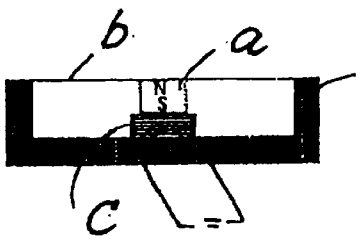
FIG. 5 shows different embodiments of the generator.
Figure 5B:
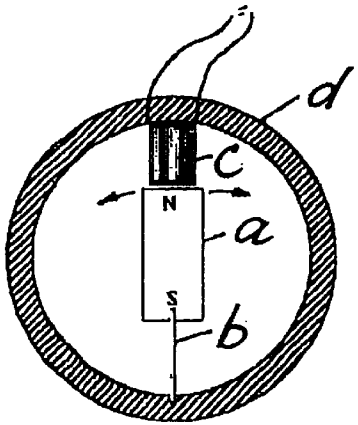
Figure 5A:
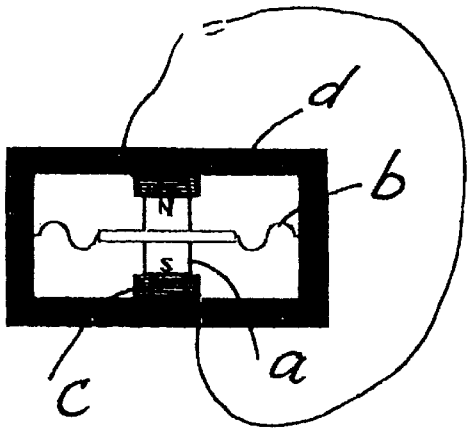

FIG. 5 shows three different exemplary embodiments of the generator. The housing d) may be made, for example, of plastic, and attached to the garment with the aid of a fastening device. This may consist of holes to enable the generator to be sewn onto the garment, a snap fastener device, a Velcro fastener device etc.

The oscillating generator can also be made of a piezoelectric material which when mechanically actuated transmits an electric pulse. Such piezoelectric materials are obtainable as rods, rings and/or film which on deformation transmit an electric impulse.

What is claimed is:

1. A method of transporting liquid in a porous textile material selected from the group consisting of clothing, garments, shoes and tents, which comprises forcing the liquid to travel through the material by applying electric pulses to conductors or semiconductors which are associated to each side of the material.

2. The method according to claim 1, wherein the material comprises several layers of textiles which together form a laminate.

3. The method according to claim 1, wherein the conductors and semiconductors are woven onto the material.

4. The method according to claim 1, wherein the conductors and semiconductors are printed onto the material.

5. The method according to claim 1, wherein the conductors and semiconductors are thread-shaped and adapted to be woven into a garment to be treated.

6. The method according to claim 1, wherein the conductors and semiconductors comprise a perforated film adapted to be attached to a garment to be treated.

7. The method according to claim 1, wherein the conductors and semiconductors are connected to an electric pulse transmitter, which comprises an oscillating electric generator adapted to be attached to a garment worn by a person and actuated by the person's own movements.

8. The method according to claim 7, wherein the oscillating electric generator comprises a spring-suspended permanent magnet, a coil and a housing.

9. The method according to claim 7, wherein the oscillating electric generator comprises a piezoelectric material, which on mechanical actuation transmits an electric pulse.

* * * * *